US005272757A

United States Patent [19]

Scofield et al.

[11] Patent Number: 5,272,757

[45] Date of Patent: Dec. 21, 1993

[54] MULTI-DIMENSIONAL REPRODUCTION SYSTEM

[75] Inventors: William C. Scofield; Lynn A. McCroskey, both of Birmingham, Ala.

[73] Assignee: Sonics Associates, Inc., Birmingham, Ala.

[21] Appl. No.: 819,625

[22] Filed: Jan. 9, 1992

Related U.S. Application Data

[63] Continuation of Ser. No. 581,468, Sep. 12, 1990, abandoned.

[51] Int. Cl.[5] ..... H04R 5/02

[52] U.S. Cl. ..... 381/25; 381/183; 381/187

[58] Field of Search ..... 381/25, 1, 183, 187

[56] References Cited

U.S. PATENT DOCUMENTS

| | | | |
|---|---|---|---|
| 3,906,160 | 9/1975 | Nakamura et al. . | |
| 4,005,278 | 1/1977 | Gorike | 381/187 |
| 4,110,583 | 8/1978 | Lepper . | |
| 4,574,391 | 3/1986 | Morishima | 381/24 |
| 4,641,345 | 2/1987 | Takahashi | 381/86 |
| 4,845,751 | 7/1989 | Schwab | 381/25 |
| 4,888,804 | 12/1989 | Karppala, Jr. | 381/25 |
| 4,952,024 | 8/1990 | Gale . | |
| 4,967,268 | 10/1990 | Lipton et al. . | |
| 4,993,074 | 2/1991 | Carroll . | |
| 5,034,983 | 7/1991 | Cooper et al. | 381/25 |

FOREIGN PATENT DOCUMENTS

| | | | |
|---|---|---|---|
| 0284286A2 | 9/1988 | European Pat. Off. . | |
| 0421681A2 | 10/1991 | European Pat. Off. . | |
| 3214080 | 10/1983 | Fed. Rep. of Germany | 381/24 |
| 53-23601 | 3/1978 | Japan . | |
| 55-90197 | 8/1980 | Japan . | |
| 55-077295 | 10/1980 | Japan . | |
| 0047197 | 4/1981 | Japan | 381/86 |

OTHER PUBLICATIONS

"Lokalisierung von Schallereignissen—biphones/quadro-biphones Verfahren" by Toshiy Inoue, Funkschau, vol. 49, No. 10, May 1977, pp. 57-58; 71-72.

*Primary Examiner*—Forester W. Isen

*Attorney, Agent, or Firm*—Ross, Howison, Clapp & Korn

[57] ABSTRACT

A multi-dimensional sound reproduction system is provided for receiving a binaural or other appropriately produced recording on left and right channels and outputting the recording to localized speakers (58) and (60). The localized speakers (58) and (60) are supported on a pair of glasses (70) in housings (80) and (82). Each of the speakers (58) and (60) are directed rearward toward the pinna (68) of the associated left and right ear of the individual and disposed proximate to the zygomatic arch of the listener (26). In this manner, the localized speakers (58) and (60) are separated from the opposite one of the ears of the listener (26) such as not to disturb the conch resonance or the unique pinna response of the listener's ear. The low frequency end of the frequency spectrum for the binaural recording is filtered from the input to the localized speakers (58) and (60), summed and then output on external speaker (52). A display (64) is provided for outputting visual cues to the listener (26) to assist in localizing sound.

17 Claims, 5 Drawing Sheets

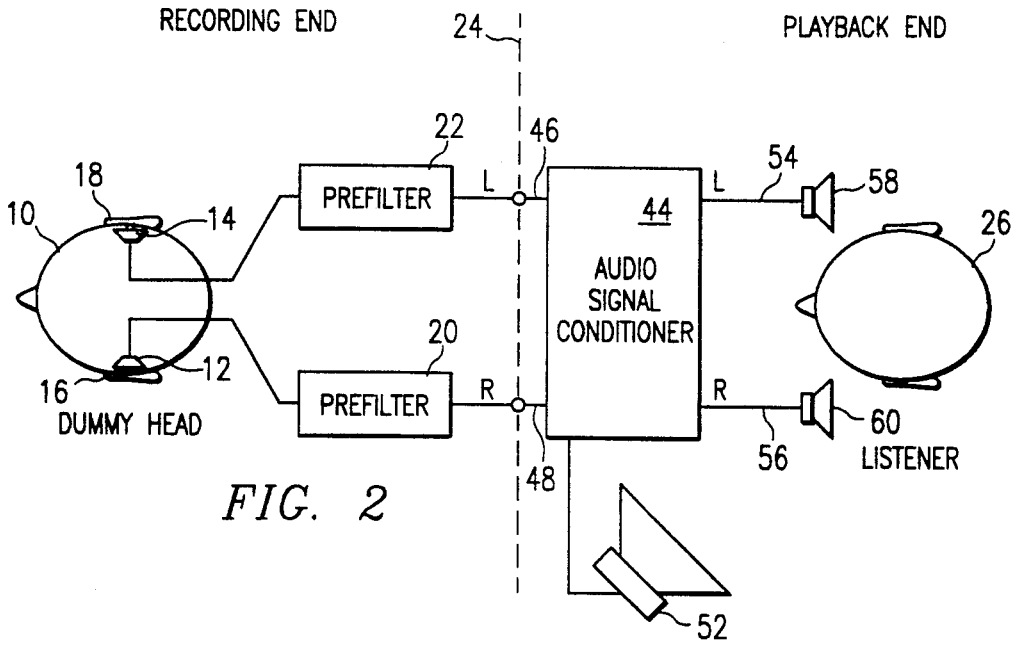
FIG. 2
FIG. 3
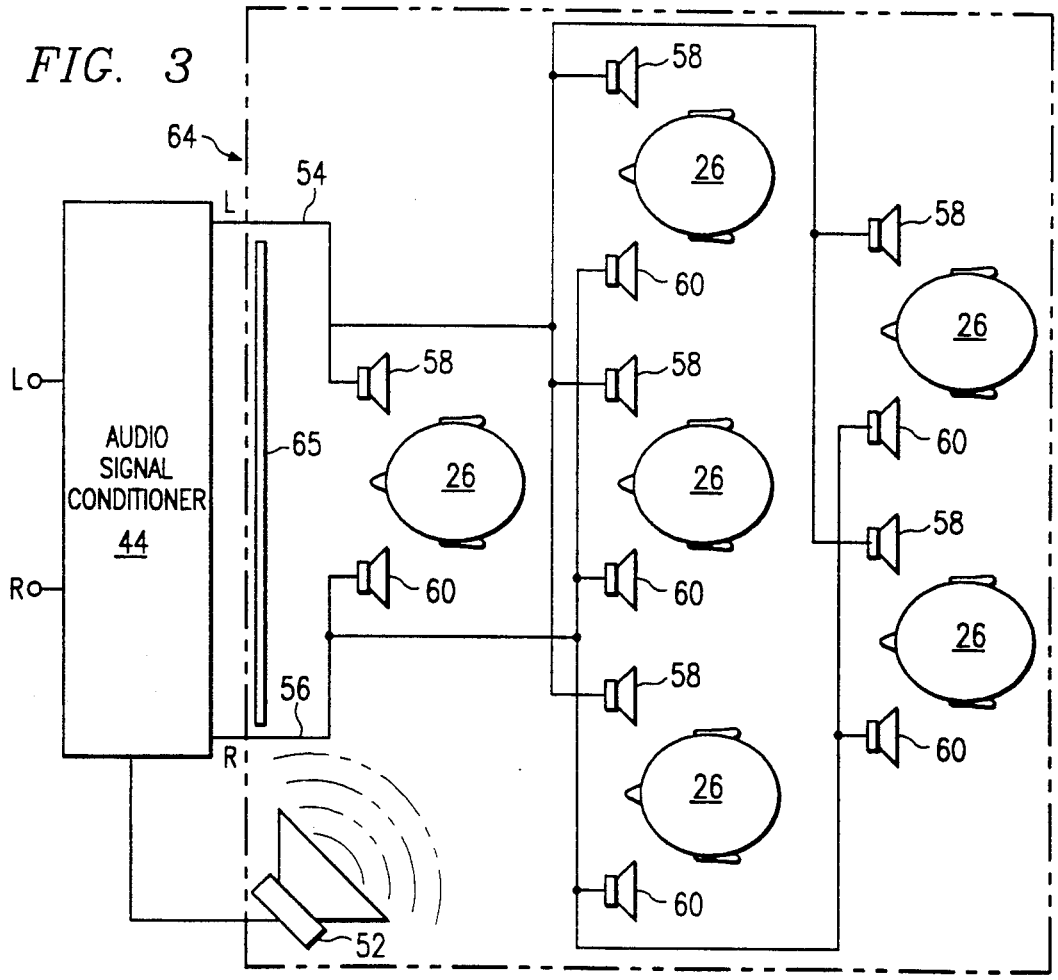

MULTI-DIMENSIONAL REPRODUCTION SYSTEM

This application is a continuation of application Ser. No. 07/581,468, filed Sep. 12, 1990.

TECHNICAL FIELD OF THE INVENTION

The present invention pertains in general to a sound reproduction system, and more particularly, to a sound reproduction system for a multi-dimensional space using a binaural recording.

BACKGROUND OF THE INVENTION

In stereophonic sound systems, such as those found in home entertainment applications, there is an attempt to control the localization of sounds typically using balance potentiometers. In this process, the relative level between two loudspeakers affects where the phantom image will exist as perceived by a listener positioned equidistant from two loudspeakers with respect to a single plane. The perception of where the sound originates, i.e., the phantom image, has also been observed to be a function of the delay between the two otherwise identical sources. For gradual increasing delays, which are on the order of the Interaural Time Difference (ITD) between the ears, the phantom image will shift toward the real undelayed source, which is disposed away from the phantom image. As the amount of delay is increased toward 10 mS, sound direction is "fused" to the speaker from which the sound first arrived. In fact, it has been observed that if two similar sounds, which originate from separate sources are delayed with repsect to each other by an amount that is between 10 mS–50 mS, a listener who is positioned equidistant from the two loudspeakers will perceive the sound to be coming from the direction of the speaker whose sound arrives first, to the exclusion of the second speaker. This has been referred to as the Law of the First Wavefront, the Precedence Effect or the Haas Effect.

For sound arriving from two different sources, be they reflections or delayed sources, the sound can either appear as an echo to an individual, or as just a mere coloration of the direct sound. If the delay between two identical sounds is separated in time by around 10 mS, the sound will be perceived as a coloration of the direct sound, whereas for delays greater than around 50 mS, the sound will be perceived as an echo. Therefore, if the delayed sound were directed toward the listener from a rearward position with a delay between 10–50 mS relative to the direct sound, the listener would not perceive the location of the rearmost sound source, but, rather, he would experience a fuller and perhaps more intelligible sound at his location. Essentially, the human ear tends to lock on sound which arrives first.

The above observations can generally be explained based on the theory that the position of a sound source is cued by interaural differences in the intensity and time of arrival (phase). This is the so-called duplex theory of localization which states that phase is the main mechanism of the localization below 1500 Hz, while for frequencies above around 4000 Hz, intensity is the main localization cue. For the intervening range of frequencies, localization is not good and it may be that confusion comes about because of conflict between the two mechanisms over this range of frequencies. The duplex theory of localization will break down when it comes to defining unique sound source positions. A sound source which is located directly in front of a listener and one which is located directly behind a listener provides identical signals to the ears according to the duplex theory. However, it is a common everyday experience to discriminate between front and back localized sounds. There is much evidence to support the idea that a third mechanism contributes to the localization of sound, and that is the pinna transformation of sound.

Over the years, experiments have shown that the pinna performs a spectral modification which gives additional cues for the localization of sounds. This is particularly true with respect to elevation and front-back cues. The brain/nervous systems appears to process angular dependant spectral information in order to determine direction. This is due to the complex shape of the pinna which, when presented to a sound in front of the user, results in a significantly different response to the ear canal as compared to that for a sound originating from behind the listener. This spectral modification is also affected by the head and torso.

For multi-dimensional sound, typically referred to as 3-D sound, it is necessary to localize the sound, identify moving sound sources, enlarge the ideal listening area for the listener and remove the actual sound from a viewing area, such as a movie screen, to the individual. When considering only a single individual in a room, multi-dimensional sound has been reproduced through either headphones or through loudspeakers. With respect to the loudspeakers, it is important that the listener not move, since very complex systems have been developed which provide for cancellation of cross-talk between loudspeakers. Further, the rooms in which these experiments have been carried out typically are acoustically "dead" rooms.

One system that has been provided to reproduce binaural signals though loudspeakers is the Q-biphonic system. This system utilizes a binaural synthesizer that takes pre-recorded monaural sources and converts them into binaural signals along with loudspeaker cross-talk cancellation circuitry necessary for playback through loudspeakers. These systems claim to achieve full azimuthal localization in a four speaker system in addition to elevation localization. This system is very sensitive to head movement and is restricted to only one listening position. In the early days of this system, it was found that an anechoic space was needed.

Another solution proposed for a multi-dimensional system is one utilizing a multiple delay line system controlled by a personal computer. Provisions are made for six delay lines and an additional four non-delay lines. By utilizing a computer "mouse", which provides coordinate manipulation, sounds can be localized by controlling the signal arrival times between loudspeakers in a multiple speaker system. In addition to the adjustable delay, there is also an adjustable attenuation provided for each line. The individual delay times and attenuation calculations, which are accomplished on a computer, achieve the desired effect, i.e., phantom imaging. Delay times can be updated to account for moving sources through the use of the mouse, and preset configurations can be stored for future reference.

Some present research that is going on in the multi-dimensional sound system field is that for developing a multisensory "virtual environment" work station (VIEW) for use in space station teleoperation, tele-presence and automation activities. The auditory requirements for this project led to the prototyping of a binaural signal processor for converting generated or recorded sounds into binaural signals. Researchers measured a subject's pinna responses as a function of azimuth and elevation and arrived at pure head related transfer functions (HRTFs) using Fast Fourier Transform techniques. These HRTFs were implemented in a Digital Signal Processing (DSP) device which allowed the user to apply direction dependent equalization to an incoming signal. By establishing the proper relationship between the ITD, the Interaural Level Difference (ILD), and the HRTF, experimenters were able to synthesize free field stimuli and present this over headphones. Motion trajectories and static locations that represented greater resolution of HRTFs than measured were arrived at through interpolation. However, this system had some problems with front-back reversals.

To record binaural soundtracks, a recording system has been utilized that employs an artificial head for making the recordings. This is sometimes referred to as a "dummy" head. The system utilizes an artificial head that is fabricated from an anthropromorphic mannequin-like device that has lifelike pinnas and microphones disposed in the ear canals. The microphones are disposed on either side of the artificial head, and these microphones are utilized in conjunction with a binaural processor that converts the standard signals into binaural signals. The artificial head is typically utilized as an area microphone with additional circuitry provided for replicating the recordings of soloists which are converted and blended with the area recording.

In the recording process utilizing the artificial head, the head is equalized for a flat free-field response at frontal incidence. This accomplishes two things. First, the experience of listening to binaural recordings through headphones typically produces interior or "in-the-head" sounds. This is due to the disturbance of the conch resonance in the pinna by earphone cups, which causes a sense of nearness and "in the head" localization. The free-field equalization removes this resonance during recording, while for playback, the headphones are equalized to restore this resonance. It can be appreciated that the headphones destroy the natural conch resonance. The equalization of the response with the headphones results in better external localization, which is still imperfect because of the uniqueness of the transfer function of the pinna of each individual.

Secondly, the artificial head recordings made with the free-field equalization will reproduce with good results through regular stereo equipment. Furthermore, if these binaural recordings are reproduced through loudspeakers utilizing cross-talk cancelization (transaural listening), the conch resonance of the pinna is not presented twice, but is only restored by the natural action of the outer ear.

In U.S. Pat. No. 4,817,149, issued Mar. 28, 1989, a system is disclosed that enables sounds to be localized from all directions when played through headphones. Elevation and front/back cues are established utilizing direction-dependant filtering while horizontal (aximuthal) localization is achieved by control of interaural time differences.

SUMMARY OF THE INVENTION

The present invention disclosed and claimed herein comprises a multi-dimensional sound reproduction system for reproducing binaural recordings having first and second channels. The system includes first and second localized speakers for receiving and reproducing the first and second channels, respectively, of the binaural recording. A support member is provided for disposing the first and second localized speakers in a substantially fixed position on opposite sides of the head. The first and second localized speakers are supported such that they are proximate to the left and right ears, respectively, of the listener in such a position that each of the first and second localized speakers does not disturb the natural frequency response of the ears of the listener. They are sufficiently close to the head such that cross-talk between each of the first and second localized speakers and the ear on the opposite side of the head of the listener is minimized.

In another embodiment of the present invention, circuitry is provided for extracting a portion of the frequency spectrum from each of the first and second channels of the binaural recording. At least one of these extracted portions of the frequency spectrum of the first and second channels of the binaural recording is output to an external speaker that is disposed away from the listener. In one aspect of the present invention, this comprises a lowpass filter/crossover circuit wherein the low frequency portion of each of the first and second channels of the binaural recording are extracted, summed and then output to the external speaker. Further, a highpass filter/crossover circuit is utilized to remove the low frequency portion of the frequency spectrum from the signals input to the first and second localized speakers.

In a further embodiment of the present invention, the first and second localized speakers are supported in an eyeglass frame. The eyeglass frame is supported on the listener's head with a headband. Speaker housings are disposed on the headband to secure the localized speakers. The localized speakers are positioned such that they are directed rearward toward the pinna of the associated left and right ear and disposed proximate to the zygomatic arch of the listener.

BRIEF DESCRIPTION OF THE DRAWINGS

For a more complete understanding of the present invention and the advantages thereof, reference is now made to the following description taken in conjunction with the accompanying Drawings in which:

FIG. 2 illustrates a block diagram of the present invention;

FIG. 3 illustrates a diagram of the present invention utilized with a plurality of listeners in an auditorium;

DETAILED DESCRIPTION OF THE INVENTION

Figure 1A:
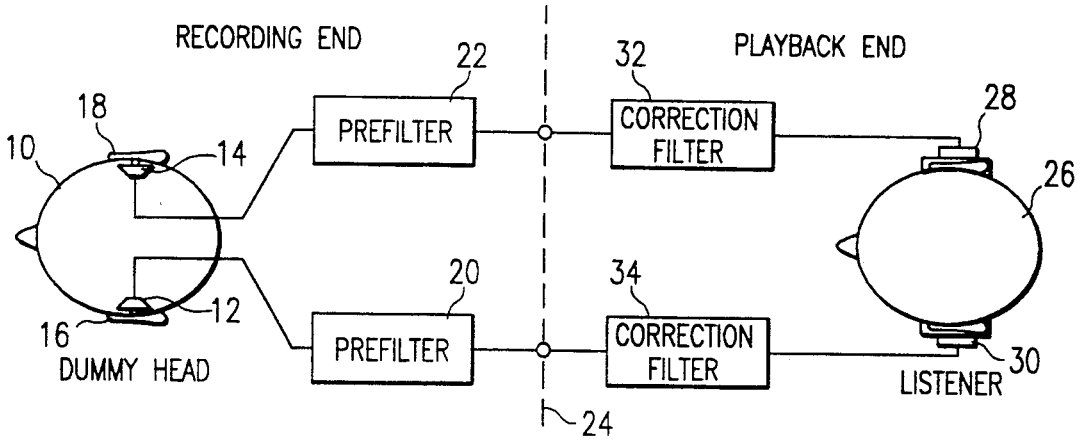
FIG. 1a (PRIOR ART)
FIGS. 1*a* and 1*b* illustrate diagrams of the prior art multi-dimensional sound systems.

Referring now to FIG. 1*a*, there is illustrated a schematic diagram of a prior art system for recording and playing back binaural sound. The prior art system is divided into a recording end and a playback end. In the recording end, a dummy head 10 is provided which has microphones 12 and 14 disposed in place of the ear canals. Two artificial pinnas 16 and 18, respectively, are provided for approximating the response of the human ear. The output of each of the microphones 12 and 14 is fed through pre-filters 20 and 22, respectively, to a plane 24, representing the barrier between the recording end and the playback end. The transfer function between the artificial ears 16 and 18 and the barrier 24 represents the first half of an equalizing system with the pre-filters 20 and 22 providing part of this equalization.

The playback end includes a listener 26 which has headphones comprised of a left earpiece 28 and a right earpiece 30. A correction filter 32 is provided between the barrier 24 and the earphone 28 and a correction filter 34 is provided between the barrier 24 and the earphone 30. The correction filter 34 is connected to the output of the pre-filter 20 and the correction filter 32 is connected to the output of the pre-filter 22. The transfer function between the barrier 24 and the earphone 30 represents the playback end transfer function. The product of the recording end transfer function and the playback end transfer function represents the overall transfer function of the system. The pre-filters 20 and 22 and the correction filters 32 and 34 provide an equalization which, when taken in conjunction with the response of the dummy head, should result in a true reproduction of the sound. It should be appreciated that the earphones 28 and 30 alter the natural response of the pinna for the listener 26, and therefore, the equalization process must account for this.

Figure 1B:
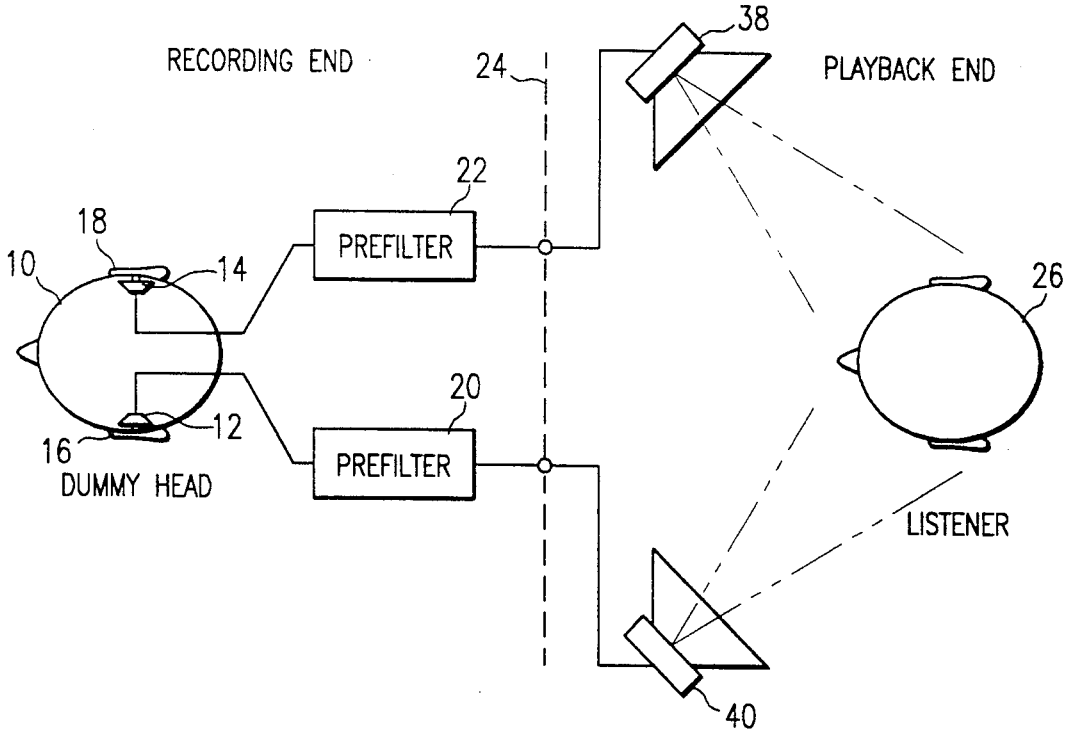
FIG. 1b (PRIOR ART)

Referring now to FIG. 1*b*, there is illustrated a diagrammatical representation of a prior art system, which is similar to the system of FIG. 1*a* with the exception that speakers 38 and 40 replace the headphones 28 and 30 and associated correction filters 32 and 34. However, when headphones are replaced by speakers, one problem that exists is cross-talk between the two speakers, since the speakers are typically disposed a large distance from the ears of the listener. Therefore, sound emanating from speaker 40 can impinge upon both ears of the listener 26, as can sound emitted by speaker 38. Further, the room acoustics would also affect the sound reproduction in that reflections occur from the walls of the room.

Headphones, as compared to speakers, are usually equalized to a free field in that their transfer function ideally corresponds to that of a typical external ear when sound is presented in a free sound field directly from the front and from a considerable distance. This does not lend itself to reproduction from a loudspeaker. In general, loudspeakers will require some type of equalization to be performed at the recording end, but this will still result in distortions of tone and color. It can be seen that although the loudspeakers can be somewhat equalized with respect to a given position, the cross-talk of the speakers must be accounted for. However, when dealing with a large auditorium, this must occur for all the listeners at any given position, which is difficult at best.

Referring now to FIG. 2, there is illustrated a diagram of the system of the present invention. The binaural recording is input to a signal conditioner 44 as a left and a right signal on lines 46 and 48, respectively. The signal conditioner 44, as will be described hereinbelow, is operable to combine the left and the right signals for frequencies below 250 Hz and input them to low frequency speaker 52, there being no left or right distinctions made in the speaker 52. In addition, the left and right signals of lines 46 and 48 are output as separate signals on left and right lines 54 and 56 to localized speakers 58 and 60 which are disposed proximate to the ears of the listener 26. The localized speakers 58 and 60 are disposed such that they do not disturb the natural conch resonance of the ears of the listener 26, and they are disposed such that the sound emitted from either of the speakers 58 and 60 is significantly attenuated with respect to the hearing on the opposite side of the head. This is facilitated by disposing the localized speakers 58 and 60 proximate to the head such that the natural separation provided by the head will be maintained.

Only signals above 250 Hz are transmitted to the localized speakers 58 and 60. As will be described hereinbelow, a delay is provided to the sound emitted from localized speakers 58 and 60 as compared to that emitted from speaker 52, such that the sound emitted from speaker 52 will arrive at the location of the listener 26 at the approximate time that the sound is emitted from localized speakers 58 and 60, within at worst plus and minus 25 ms. This accounts for the sound delay through the room and the distance of the listener 26 from the speaker 52. It has been noted that the important localization cues are not contained in the low frequency portion of the signal. Therefore, this low frequency portion of the audio spectrum is split out and routed to the listeners through the speaker 52. In this manner, the amount of sound energy that can be output at the low frequencies is increased, since the small size of the transducers that will be utilized for the localized speakers 58 and 60 cannot reproduce low frequency sounds with any acceptable fidelity.

Referring now to FIG. 3, there is illustrated a diagram of the system utilized with a plurality of listeners 26. Each of the listeners 26 has associated therewith a set of localized speakers 58 and 60. The listeners 26 are disposed in a room 64 with the speaker 52 disposed in a predetermined and fixed location. Since it is desirable that sound from the speaker 52 arrive at all of the listeners 26 generally at the same time, the speaker 52 would be located some distance from the listeners 26, it being understood that FIG. 3 is not drawn to scale. A viewing screen 65 is disposed in front of the listeners 26 to provide visual cues.

The localized speakers 58 and 60 are supported on the heads of listeners 26 such that they are maintained at a predetermined and substantially fixed position relative to the head. Therefore, if the head were to move when, for example, viewing a movie, there would be no phase change in the sound arriving at either of the ears of the listener 26. Therefore, a support member is provided which is affixed to the head of the listener 26 to support the localized speakers 58 and 60. In the preferred embodiment, groups consisting of six listeners are connected to common wires 54 and 56, such that the localized speakers 58 and 60 associated with each of the listeners 26 in a common group are connected to these wires, respectively. The sound level is adjusted such that each listener 26 will hear the sound at the appropriate phase from the associated one of the localized speakers 58 and 60. However, it has been determined experimentally that a listener 26 disposed in an adjacent seat with sound being emitted from his associated localized speakers 58 and 60 will not interfere with the sound received by the one listener 26. This is due to the fact that the sound levels are relatively low. If the localized speakers 58 and 60 are removed, then a listener 26 can hear sound emitted from localized speakers 58 and 60 among the listeners' seats adjacent thereto. The human ear "locks" onto the sound emitted from its associated localized speakers 58 and 60 and tends to ignore the sound from speakers disposed adjacent thereto. This is the result of many factors, including the Law of the First Wavefront.

The combination of the localized speakers 58 and 60 and visual cues on the screen 65 provide an additional aspect to the listener's ability to localize sound. In general, the listener cannot localize sound very well when it is directly in front or in back of the listener's head. Some type of head movement or visual cue would normally facilitate localization of the sound. Since the localized speakers 58 and 60 are fixed to the listener's head, visual cues on the screen 65 provide the listeners 26 with additional information to assist in localizing the sound.

Figure 4:
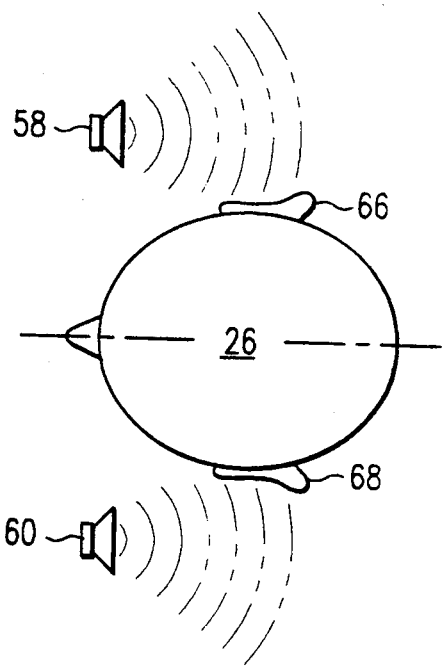
FIG. 4 illustrates a detail of the orientation of the localized speakers.

Referring now to FIG. 4, there is illustrated a detail of the orientation of the localized speakers 58 and 60 relative to the listener 26. The localized speaker 58 is disposed proximate to the right ear of the listener and its associated pinna 66. Similarly, the localized speaker 60 is disposed proximate to the left ear of the listener 26 and the associated pinna 68. In the preferred embodiment, the localized speakers 58 and 60 are disposed forward of the pinnas 66 and 68, respectively, and proximate to the head of the listener 26. It has been determined experimentally that the optimum sound reproduction occurs when the speaker is directed rearward and disposed proximate to the zygomatic arch of the listener 26. If the associated localized speaker 58 or 60 is moved outward, directly to the side of the ear, the actual physical size of the speaker tends to disturb the conch resonance. However, if the speaker were reduced to an extremely small size, this would be acceptable.

It is important that the speaker not be moved too far from the listener, as cross-talk would occur. Of course, any type of separation in the front, the rear or on top of the head would improve this. The torso, of course, provides separation beneath the head, but it would be necessary to improve the separation in the space forward, rearward and upward of the head if the localized speakers 58 and 60 were moved away from the head. However, in the preferred embodiment, the localized speakers 58 and 60 are designed to be utilized in an auditorium with multiple users all receiving the same or similar signals. Therefore, they are disposed as close to the ear as possible without disturbing the conch resonance and to minimize the sound level necessary for output from the localized speakers 58 and 60.

Figure 5:
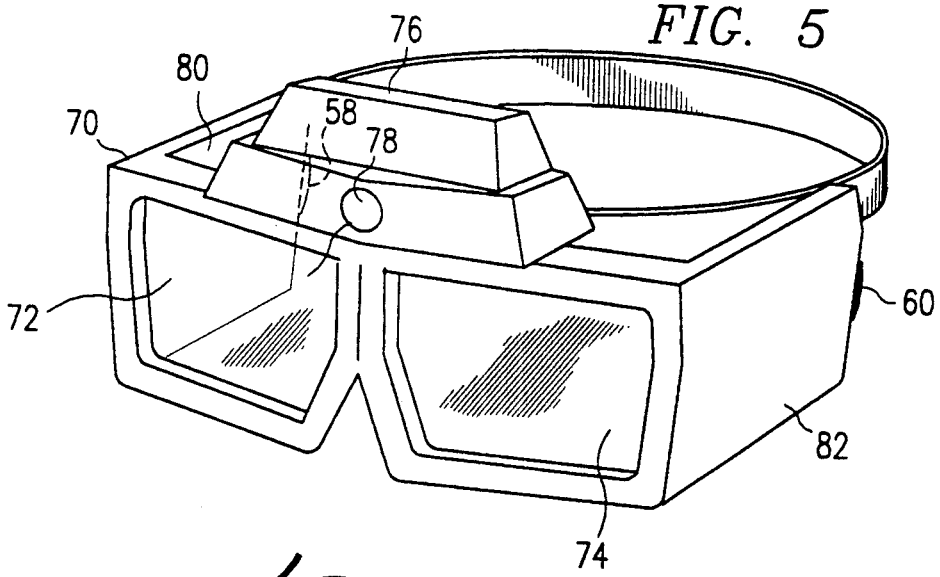
FIG. 5 illustrates a perspective view of the support mechanism for these speakers.

Referring now to FIG. 5, there is illustrated a perspective view of the support mechanism for the localized speakers 58 and 60. The localized speakers 58 and 60 are supported in a pair of three-dimensional glasses 70, which are designed for three-dimensional viewing. These glasses 70 typically have LCD lenses 72 and 74 which operate as shutters to provide the three-dimensional effect. A control circuit is disposed in a housing 76 which has a photo transistor 78 disposed on the frontal face thereof. The photo transistor 78 is part of a communications system that allows the synchronization signals to be transmitted to the glasses 70.

Housing 80 is disposed on one side of the glasses 70 for supporting the localized speaker 58. A housing 82 is disposed on the opposite side of the glasses 70 for supporting the localized speaker 60. The housings 80 and 82 provide the proper acoustic termination for the speakers 58 and 60, such that the frequency response thereof is optimized. The speakers 58 and 60 are typically fabricated from a dynamic loudspeaker, which is conventionally available for use in stereo headphones.

Figure 6:
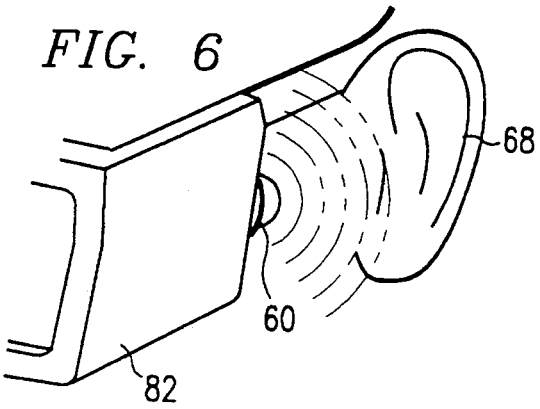
FIG. 6 illustrates a side view of the housing and the localized speaker.

Referring now to FIG. 6, there is illustrated a side view of the housing 82 and the localized speaker 60. The localized speaker 60, as described above, is disposed such that it is proximate to the side of the head in the area of the zygomatic arch. It is directed rearward toward the pinna 68 of the left ear of the listener 26 with the sound emitted therefrom being picked up by the pinna 68 and the ear canal of the left ear of the listener 26.

Figure 7:
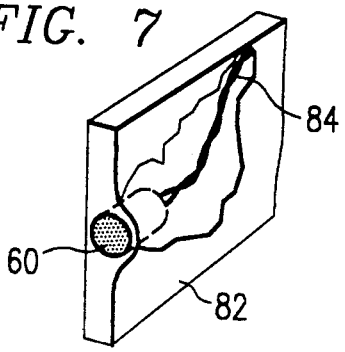
FIG. 7 illustrates a detail rear perspective view of the housing for containing one of the localized speakers.

Referring now to FIG. 7, there is illustrated a detailed view of the housing 82 and the speaker 60. The housing 82 is slightly widened at the mounting point for the localized speaker 60, which, as described above, is a small dynamic loudspeaker. A wire 84 is provided which is disposed through the housing 82 up to the control circuitry in the housing 76. Alternatively, the wire 84 can go to a separate control/driving circuit that is external to the housing 82 and the glasses 70. The housing 82 is fabricated such that it has a cavity disposed therein at the rear of the localized speaker 60. The size of this cavity is experimentally determined and is a function of the particular brand of dynamic loudspeaker utilized for the localized speakers 58 and 60. This cavity is determined by measuring the response of the particular dynamic loudspeaker with a variable cavity disposed on the rear side thereof. This cavity is varied until an acceptable response is achieved.

Figure 8:
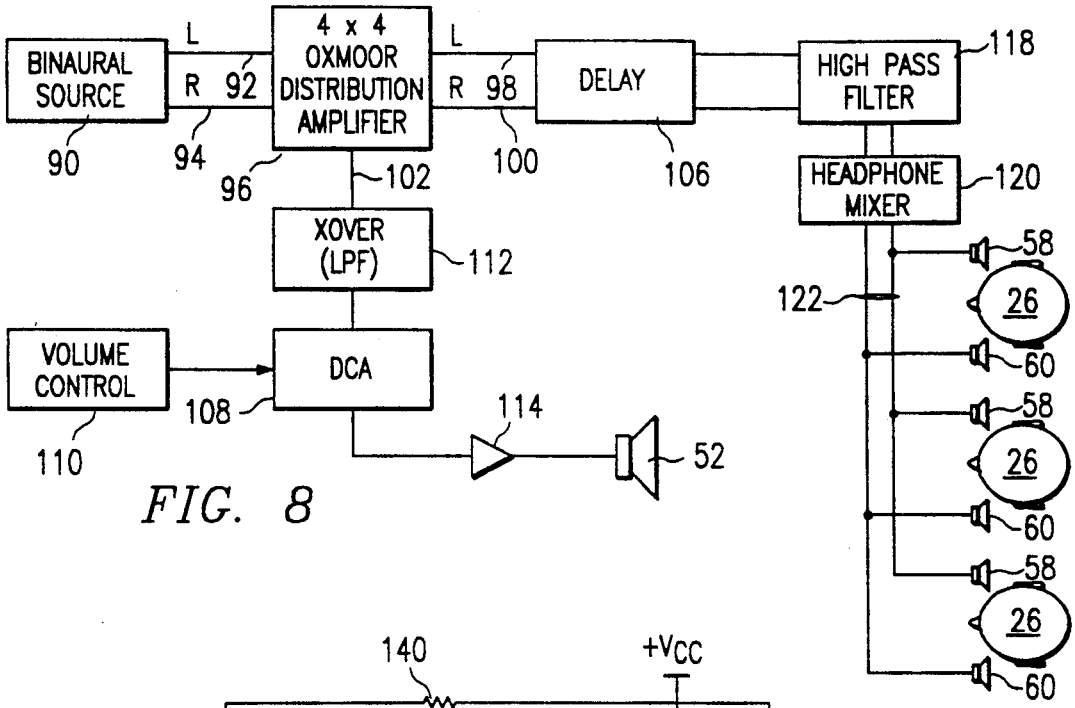
FIG. 8 illustrates a schematic block diagram of the system for generating the localized speaker driving signals.

Referring now to FIG. 8, there is illustrated a schematic block diagram of the system for driving the localized speakers 58 and 60 and also the low frequency speaker 52. The binaural recording system typically provides an output from a tape recording, which is played back and output from a binaural source 90 to provide left and right signals on lines 92 and 94. These are input to a 4×4 circuit 96 that outputs left and right signals on lines 98 and 100 for localized speakers 58 and 60, and also a summed signal on a line 102, which comprises the sum of both the left and right signals. The 4×4 circuit 96 is manufactured by OXMOOR CORPORATION as a Buffer Amplifier and is operable to receive up to four inputs and provide up to four outputs as any combination of the four inputs or as the buffered form of the inputs. The signal line 102 is output to a crossover circuit 112 which is essentially a low pass filter. This rejects all signals above approximately 250 Hz. The crossover circuit 112 is typical of Part No. AC 22, which is a stereo two-way crossover, manufactured by RANE CORPORATION. The output of the crossover 112 is input to a digital control amplifier (DCA) 108 to control the signal level. This is controlled by volume level control 110. The DCA 108 is typical of Part No. DCA-2, manufactured by OXMOOR CORPORATION. The output of the DCA 108 is input to an amplifier 114 which drives the speaker 52 with the low frequency signals. The amplifier 114 is typical of Part No. 800X, manufactured by SONICS ASSOCIATES-,INCORPORATED.

The left and right signals on lines 98 and 100 from the 4×4 circuit 96 are input to a delay circuit 106, which is typical of Part No. DN775, which is a Stereo Mastering Digital Delay Line, manufactured by KLARK-TEKNIK ELECTRONICS INC. The outputs of the delay circuit 106 are input to a high pass filter 118 to reject all frequencies lower than 250 Hz. The high pass filter 118 is identical to the part utilized for the crossover circuit 112. The outputs of filter 118 are input to a headphone mixer 120 to provide separate signals on a multiplicity of lines 122, each set of lines comprising a left and a right line for an associated set of localized speakers 58 and 60 for listeners 26. This is typical of Part No. HC-6, which is a headphone console, manufactured by RANE CORPORATION. The lines 122 are routed to particular listeners' localized speakers 58 and 60.

Figure 9:
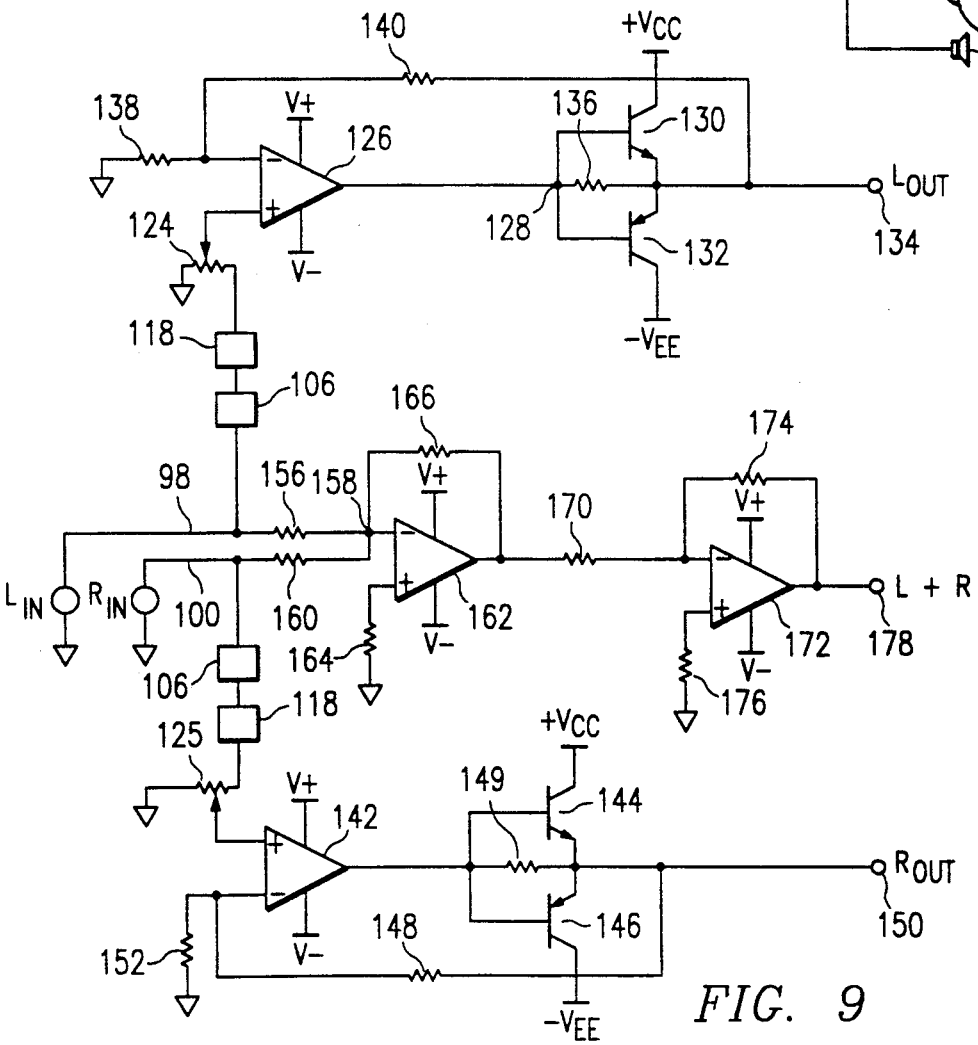
FIG. 9 illustrates a schematic diagram for generating the signals for driving the localized speakers.

Referring now to FIG. 9, there is illustrated a detailed schematic diagram of the circuit for driving the headphones. Line 98 is input through delay 106, and high pass filter 118 to the wiper of a volume control 124, the output of which is input to the positive input of an operational amplifier (op amp) 126. The output of op amp 126 is connected to a node 128 which is also connected to the base of both an NPN transistor 130 and a PNP transistor 132. Transistors 130 and 132 are configured in a push-pull configuration with the emitters thereof tied together and to an output terminal 134. The collector of transistor 130 is connected to a positive supply and the collector of transistor 132 is connected to a negative supply. The emitters of transistors 130 and 132 are also connected through a resistor 136 to the node 128. The negative input of the op amp 126 is connected through a resistor 138 to ground and also through a feedback resistor 140 to the output terminal 134.

An op amp 142 is provided with the positive input thereof connected to the output of volume control 125. The wiper of volume control 125 is connected through delay 106 and the filter 118. Op amp 142 is configured similar to op amp 126 with an associated NPN transistor 144 and PNP transistor 146, configured similar to transistors 130 and 132. A feedback resistor 148 is provided, similar to the resistor 140, with feedback resistor 148 connected to the negative input of op amp 142 and an output terminal 150. A resistor 152 is connected to the negative input of op amp 142 and ground. The volume controls 124 and 125 provide individual volume control by the listener 26.

Line 98 is also illustrated as connected through a summing resistor 156 to a summing node 158. Similarly, the line 100 is connected through a summing resistor 160 to the summing node 158. The summing node 158 is connected to the negative input of an op amp 162, the positive input of which is connected to ground through a resistor 164. The negative input of op amp 162 is connected to the output thereof through a feedback resistor 166. Op amp 162 is configured for unity gain at the first stage. The output of op amp 162 is connected through a resistor 170 to a negative input of an op amp 172. The negative input of op amp 172 is also connected to the output thereof through a resistor 174. The positive input of op amp 172 is connected to ground through a resistor 176. Op amp 172 is configured as a unity gain inverting amplifier. The output of op amp 172 is connected to an output terminal 178 to provide the sum of the left and right channels. The op amps 162 and 172 provide the function of the summing portion of 4×4 circuit 96, and are provided by way of illustration only.

Figure 10:
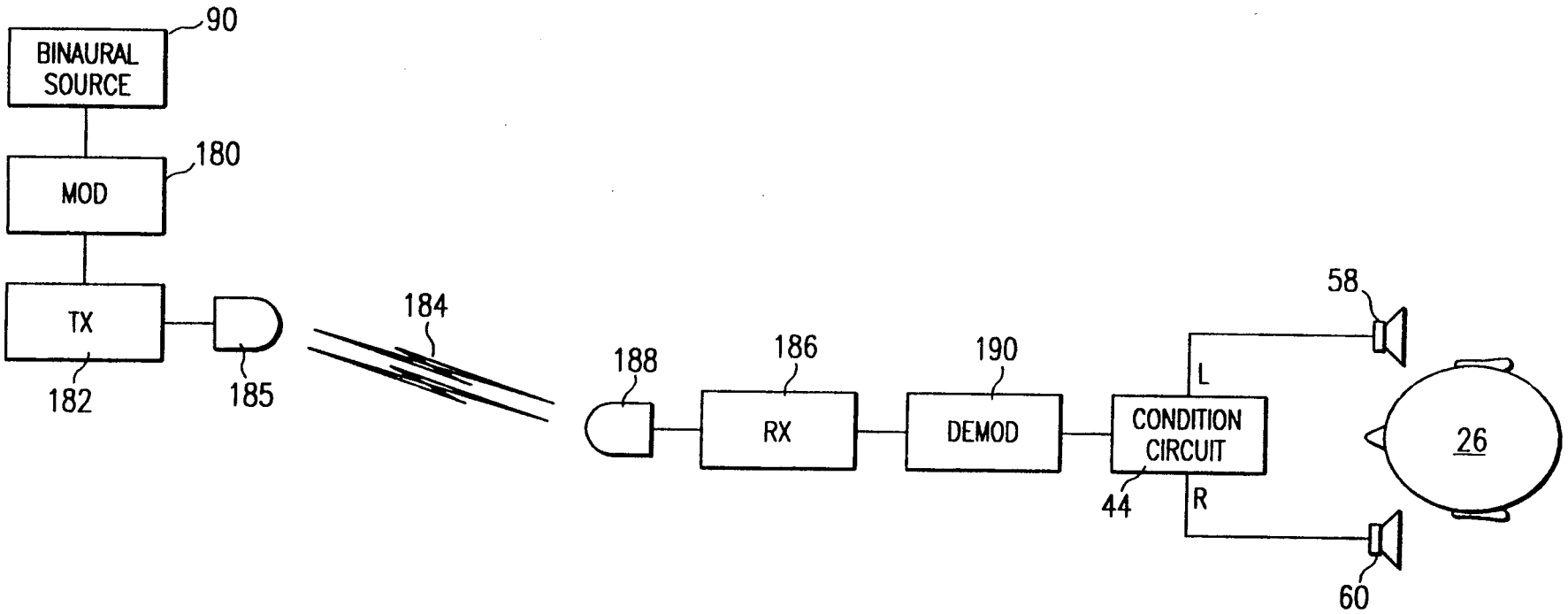
FIG. 10 illustrates a block diagram of an alternate method for transmitting the binaural signals to the listener over a wireless link.

Referring now to FIG. 10, there is illustrated a block diagram of an alternate method for transmitting the left and right signals to the localized speakers 58 and 60. The binaural source has electronic signals modulated onto a carrier by a modulator 180, the carrier then transmitted by transmitter 182 over a data link 184. The data link 184 is comprised of an infrared data link that has an infrared transmitting diode 185 disposed on the transmitter 182. A receiver 186 is provided with a receiver Light Emitting Diode 188 that receives the transmitted carrier from the diode 185. The output of the receiver 186 is demodulated by a demodulator 190 and this provides a left and right signal for input to the conditioning circuit 44.

In summary, there has been provided a multi-dimensional sound reproduction system. The system is comprised of two localized speakers which are supported in a substantially fixed relationship with respect to the head of a listener. The localized speakers are disposed proximate to the ear in such a position that they do not disturb the natural response of the ear, and sufficiently close to the head such that the cross-talk between each of the speakers and the opposite ear is minimized. Low frequency sound that does not contain important localization cues is filtered from the original binaural recording, and this is transmitted to the listener by an external speaker.

Although the preferred embodiment has been described in detail, it should be understood that various changes, substitutions and alterations can be made therein without departing from the spirit and scope of the invention as defined by the appended claims.

What is claimed is:

1. A multi-dimensional sound reproduction system for reproducing binaural audio signals having first and second channels, comprising:

a binaural audio signal source for generating first and second channels of binaural audio signals associated with the right and left ears, respectively, of a listener;

a first localized speaker for outputting as binaural sound the binaural audio signal associated with one ear of the listener;

a second localized speaker for outputting as binaural sound the binaural audio signal associated with the other ear of the listener; and a support for supporting said first and second localized speakers in a substantially fixed position on opposite sides of the head of the listener and proximate to the zygomatic arch of the listener for substantially all positions of the head of the listener, and directed rearward toward the pinna of the left and right ears of the listener for substantially all positions of the head of the listener such that each of said first and second localized speakers does not substantially disturb the natural response of the ears of the listener relative to the binaural sound output by said first and second localized speakers, the disposition of said first and second localized speakers minimizing cross-talk between each of said first and second localized speakers and the ear on the respective opposite side of the head of the listener.

2. The sound reproduction system of claim 1 and further comprising a display device for outputting visual cues to the listener which, in conjunction with the audio signals, enhances the listener's ability to localize binaural sound reproduced by said first and second localized speakers.

3. The sound reproduction system of claim 1 and further comprising:

at least one external speaker disposed away from the listener in a fixed position relative to the listener;

a filter circuit for extracting a predetermined portion of the frequency spectrum of at least one of the first and second channels of the audio signals, which predetermined portion is not adaptable to reproducing binaural recordings; and a mixing circuit for outputting the extracted portion of the frequency spectrum from the at least one of the first and second channels of the audio signals to drive said external speaker.

4. The sound reproduction system of claim 3 wherein said filter circuit is operable to extract the predetermined portion of the frequency spectrum from both of the first and second channels of the audio signals, and said mixer is operable to combine the extracted portion of the frequency spectrum of the first and second channels of the audio signals into a monaural signal for output on said external speaker.

5. The sound reproduction system of claim 3 wherein the portion of the frequency spectrum of the first and second channels of the audio signals extracted by said filter circuit comprise the low frequency end of the frequency spectrum of the first and second channels of the audio signals.

6. The sound reproduction system of claim 1 wherein the binaural audio signal generates the first and second channels of the binaural audio signals on first and second outputs and further comprising:

a communication link for connecting the first and second outputs of said binaural audio signal source to said first and second localized speakers.

7. The sound reproduction system of claim 6 wherein said communication link comprises a wireless communication link.

8. A multi-dimensional sound reproduction system for reproducing binaural audio signals having first and second channels, comprising:

a binaural audio signal source for generating first and second channels of binaural audio signals associated with the right and left ears, respectively, of a listener;

a first localized speaker for outputting as binaural sound the binaural audio signal associated with one ear of the listener;

a second localized speaker for outputting as binaural sound the binaural audio signal associated with the other ear of the listener;

a support member for being supported on the head of the listener; and first and second speaker housings secured to said support member, each of said first and second speaker housings supporting said first and second localized speakers, respectively, in a position wherein said first and second localized speakers are disposed proximate to and away from the associated one of the left and right ears of the listener;

wherein said first and second speaker housings secure and orient said associated first and second localized speakers, respectively, such that they are directed rearward toward the associated one of the pinnas of the associated one of the left and right ears of the listener and slightly forward thereof, such that each of said first and second localized speakers does not substantially disturb the natural response of the ears of the listener relative to the binaural sound output by said first and second localized speakers.

9. The sound reproduction system of claim 8 wherein said first and second localized speakers are supported by said associated first and second speaker housings, respectively, such that they are disposed proximate to the zygomatic arch of the listener on the associated side of the listener's head.

10. The sound reproduction system of claim 8 wherein each of said first and second speaker housings includes a cavity for being disposed about the rear of said associated first and second localized speakers to provide the proper acoustic termination for said associated first and second localized speakers.

11. A method for reproducing binaural audio signals having first and second channels, comprising the steps of:

generating the first and second channels of binaural audio signals associated with the left and right ears of a listener, respectively;

disposing a first localized speaker proximate to the zygomatic arch of one of the left and right ears of the listener for substantially all positions of the head of the listener, and directed rearward toward the pinna of the one of the left and right ears of the listener for substantially all positions of the head of the listener, and in such a position that the first localized speaker does not substantially disturb the natural frequency response of the ears of the listener relative to the binaural sound output by the first localized speaker, the first localized speaker being sufficiently close to the head, such that cross-talk between the first localized speaker and the ear of the listener on the opposite side of the head is substantially minimized;

disposing a second localized speaker on the opposite side of the head from the first localized speaker and proximate to the zygomatic arch of the other of the left and right ears of the listener for substantially all positions of the head of the listener, and directed rearward toward the pinna of the other of the left and right ears of the listener for substantially all positions of the head of the listener, and in such a position that the second localized speaker does not substantially disturb the natural frequency response of the ears of the listener relative to the binaural sound output by the second localized speaker, the second localized speaker being sufficiently close to the head such that cross-talk between the second localized speaker and the ear on the opposite side of the head is substantially minimized;

inputting the first channel of the audio signal to the first localized speaker and outputting binaural sound therefrom;

inputting the second channel of the audio signal to the second localized speaker and outputting binaural sound therefrom; and supporting the first and second localized speakers in their respective position such that the relative positions are substantially fixed relative to the head of the listener and for substantially all positions of the head of the listener.

12. The method of claim 11 and further comprising:

extracting a predetermined portion of the frequency spectrum from at least one of the first and second channels of the binaural audio signals, which predetermined portion is not adaptable to reproducing binaural recordings;

providing an external speaker that is in a fixed position relative to the listener and disposed away from the listener; and outputting the extracted portion of the frequency spectrum of the first or second channel of the binaural audio signals to the speaker.

13. The method of claim 12 wherein the step of extracting is operable to extract the predetermined portion of the frequency spectrum from both the first and second channels of the binaural audio signals.

14. The method of claim 12 wherein the extracted portion comprises the lower end of the frequency spectrum that extends from a predetermined frequency point downward in frequency.

15. The method of claim 11 and further comprising outputting visual cues to the listener which, in conjunction with the binaural audio signals, enhance the listener's ability to integrate the visual and auditory cues.

16. The method of claim 11 and further comprising:

generating the binaural audio signals on the first and second channels at a point remote from the listener and not connected thereto; and transmitting the binaural audio signals over a communication link to the first and second localized speakers.

17. The method of claim 16 wherein the communication link is a wireless communication link.

* * * * *